US011441387B2

(12) United States Patent
El Nekhily et al.

(10) Patent No.: US 11,441,387 B2
(45) Date of Patent: Sep. 13, 2022

(54) METHOD OF SECURING A WELL WITH SHALLOW LEAK IN UPWARD CROSS FLOW

(71) Applicant: SAUDI ARABIAN OIL COMPANY, Dhahran (SA)

(72) Inventors: Mohamed M. El Nekhily, Al-Khobar (SA); Ibrahim A. Al-Obaidi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 58 days.

(21) Appl. No.: 17/062,862

(22) Filed: Oct. 5, 2020

(65) Prior Publication Data

US 2022/0106856 A1 Apr. 7, 2022

(51) Int. Cl.

| | |
|---|---|
| ***E21B 29/10*** | (2006.01) |
| ***E21B 43/10*** | (2006.01) |
| ***E21B 34/08*** | (2006.01) |
| ***E21B 33/12*** | (2006.01) |
| ***E21B 47/10*** | (2012.01) |

(52) U.S. Cl.

CPC ..... *E21B 34/08* (2013.01); *E21B 29/10* (2013.01); *E21B 33/1212* (2013.01); *E21B 43/10* (2013.01); *E21B 47/10* (2013.01)

(58) Field of Classification Search

CPC ..... E21B 47/10; E21B 34/08; E21B 33/1212; E21B 29/10; E21B 43/10

See application file for complete search history.

(56) References Cited

U.S. PATENT DOCUMENTS

| | | | | |
|---|---|---|---|---|
| 3,194,310 | A * | 7/1965 | Loomis | E21B 29/10 166/250.08 |
| 4,538,684 | A | 9/1985 | Sheffield | |
| 8,789,621 | B2 * | 7/2014 | Ganzinotti, II | E21B 33/043 166/380 |
| 10,370,943 | B2 | 8/2019 | El Nekhily et al. | |

(Continued)

OTHER PUBLICATIONS

El-Nekhily et al.; "A Well Control Procedure for Wells with High Rate Upward Crossflow", SPE/IADC-189308-MS; Society of Petroleum Engineers Inc.; Jan. 2018 (10 pages).

(Continued)

*Primary Examiner* — D. Andrews

(74) *Attorney, Agent, or Firm* — Osha Bergman Watanabe & Burton LLP

(57) ABSTRACT

A method of securing a wellbore experiencing upward crossflow includes determining a depth of a leak in a first wellbore casing tubular and identifying a second wellbore casing tubular downhole of the leak depth. From a surface, a well control tool is incrementally lowered into the wellbore until a lower tool string of the well control tool is positioned in mating contact with an end receptacle of the second wellbore casing tubular. The lower tool string is exposed to the upward crossflow during lowering of the well control tool. A unidirectional valve preinstalled inside the lower tool string inhibits movement of the upward crossflow into an upper tool string of the well control tool while permitting kill fluid pumped into the upper tool string from the surface to flow into the wellbore. The unidirectional valve is retrieved to allow additional operations in the wellbore through the lower tool string.

16 Claims, 7 Drawing Sheets

(56) References Cited

U.S. PATENT DOCUMENTS

| | | | |
|---|---|---|---|
| 2018/0100380 | A1 | 4/2018 | El Nekhily et al. |
| 2018/0171728 | A1 | 6/2018 | Killoh et al. |

OTHER PUBLICATIONS

Jahn et al.; "Hydrocarbon Exploration and Production"; Elsevier; Chapter 4; vol. 55; Mar. 13, 2008; pp. 47-81 (35 pages).
Abdel-Aal et al.; "Petroleum and Gas Field Processing"; Marcel Dekker, Inc; Chapter 1.6; Mar. 7, 2003; pp. 28-29 (2 pages).
International Search Report and Written Opinion of the International Searching Authority issued in corresponding International Application No. PCT/US2020/057675, dated Jun. 8, 2021 (13 pages).

* cited by examiner

METHOD OF SECURING A WELL WITH SHALLOW LEAK IN UPWARD CROSS FLOW

BACKGROUND

Crossflow occurs when fluid flows out of a higher pressured formation zone, travels along a wellbore to a lower pressured formation zone, and then flows into the lower pressured formation zone. Crossflow can be upward if the lower pressured formation zone is at a shallower depth compared to the higher pressured formation zone or downward if the higher pressured formation is at a shallower depth compared to the lower pressured formation zone. When upward crossflow is detected in a cased wellbore, it is typically due to a leak in a casing section that allows fluid received in the wellbore from the higher pressured formation zone to flow from the wellbore into the lower pressured formation zone. Crossflow in a wellbore is treated as a well control event that must be managed. One method for securing a wellbore experiencing upward crossflow involves isolating the leak area from the flow in the wellbore. Once the leak area is isolated, additional steps can be taken to isolate the higher pressured formation zone and place the wellbore in a condition to allow the leak in the casing section to be repaired.

U.S. Pat. No. 10,370,943 ('943 patent) describes a wellbore control tool that can be used in an operation to manage a wellbore with upward crossflow. The tool includes, in order from the downhole end, a modified liner tie-back stem, a casing joint, a liner tie-back sleeve, a liner running tool, a first pipe, a flow control sub, and a second pipe. A packer is attached to the casing joint. The tool is run into the wellbore from the surface and seated in a casing section of the wellbore that is downhole of the leak. A metal-to-metal seal is formed between the tool and casing section so that the upward wellbore flow is diverted into the downhole end of the tool rather than around the tool. The metal-to-metal seal is formed downhole of the leak. The packer provides an additional seal between the leaking casing section and the tool. The packer could be placed uphole of the leak. The flow control sub is a check valve that allows fluid flow in the downhole direction but not in the uphole direction, thereby preventing the upward wellbore flow that enters the downhole end of the tool from moving into the second pipe of the tool. A kill fluid can be pumped into the wellbore through the flow control sub to stop flow of fluid from the higher pressured formation zone into the wellbore.

The tool of the '943 patent is in the form of a string that is assembled as the tool is run into the wellbore. In some cases, the leak area enabling the upward crossflow may be at a very shallow depth such that the flow control sub cannot be safely installed. For example, the casing joint may enter the crossflow before the flow control sub can be picked up and installed into the string. If the flow control sub cannot be installed, the upward wellbore flow entering the downhole end of the tool in the wellbore will be free to move up the tool, exposing the personnel handling the operation to the risk of wellbore flow.

SUMMARY

In a first summary example, a method of well control includes, in response to detecting a crossflow in a wellbore, determining a depth of a leak that is formed at least partially in a first wellbore casing tubular installed around the wellbore and disposed in a path of the crossflow. The method includes identifying a second wellbore casing tubular installed around the wellbore and having an end receptacle that is positioned downhole of the depth of the leak. The method includes, from a surface, incrementally assembling and lowering a well control tool into the wellbore. The well control tool has a lower tool string releasably coupled to an upper tool string. The act of incrementally assembling and lowering the well control tool continues until a downhole end of the lower tool string is positioned in mating contact with the end receptacle. While incrementally lowering the well control tool into the wellbore, a conduit of the lower tool string is exposed to the crossflow and movement of the crossflow from the lower tool string into the upper tool string is inhibited by a unidirectional valve preinstalled inside the lower tool string. The method includes supplying a kill fluid from the surface into the wellbore through the well control tool and unidirectional valve. The weight of the kill fluid is selected to provide a hydrostatic head in the wellbore with an overbalance. Afterwards, the unidirectional valve is retrieved from the lower tool string to the surface to allow additional operations in the wellbore through the lower tool string.

The method may include detecting the crossflow that is moving from a first formation zone to a second formation zone, where the first formation zone is at a higher pressure and a greater depth compared to the second formation zone.

The method may include releasing the upper tool string from the lower tool string and retrieving the upper tool string to the surface prior to retrieving the unidirectional valve from the lower tool string. The method may include installing a mechanical barrier at a depth in the wellbore downhole of the end receptacle to isolate the first formation zone from a portion of the wellbore containing the leak. The method may include detecting an absence of the crossflow in the wellbore prior to installing the mechanical barrier. The absence of the crossflow may be detected by measuring a rate of fluid flow in the wellbore. The method may include retrieving the lower tool string from the wellbore to the surface after installing the mechanical barrier. The method may include repairing the leak.

The act of incrementally assembling and lowering the well control tool may include lowering the well control tool until a metal-to-metal contact is formed between a seal stem at the downhole end of the lower tool string and the end receptacle. The method may include forming a seal in an annulus between the lower tool string and the first wellbore casing tubular at a depth uphole of the depth of the leak. The seal may be formed by radially expanding at least one packer element carried on an outer diameter of the lower tool string. The method may include supplying the kill fluid from the surface into the well control tool while incrementally lowering the well control tool into the wellbore with the weight of the kill fluid selected to overcome at least a portion of an upward force generated by the crossflow.

In a second example, an apparatus for well control includes a lower tool string having a downhole end, an uphole end, and a first conduit for fluid flow extending from the downhole end to the uphole end. The lower tool string includes a seal stem at the downhole end. The seal stem has an end face to make a metal-to-metal contact. The lower tool string may include a wellbore casing tubular coupled to the seal stem and a packer coupled to the wellbore casing tubular. The packer may include at least one radially expandable packer element. The apparatus includes an upper tool string having a downhole end, an uphole end, and a second conduit for fluid flow extending from the downhole end to the uphole end. The upper tool string includes a connector releasably coupling the downhole end of the upper tool string to the uphole end of the lower tool string. The apparatus includes a unidirectional valve that is retrievably installed inside the first conduit. The unidirectional valve is operable to provide a flow of fluid in the first conduit in a direction from the uphole end of the lower tool string to the downhole end of the lower tool string. The unidirectional valve may be located in a portion of the first conduit within the wellbore casing tubular. A location of the unidirectional valve relative to the end face of the seal stem may be based on a depth of a leak in a well. The unidirectional valve may be disposed in a portion of the wellbore casing tubular immediately adjacent to the seal stem. A distance of the unidirectional valve along the lower tool string relative to the end face of the seal stem may be less than 500 feet or 152 meters.

In a third summary example, a system includes a wellbore traversing a first formation zone and a second formation zone. The first formation zone is at a higher pressure and a greater depth compared to the second formation zone. The system includes a first wellbore casing tubular and a second wellbore casing tubular installed around the wellbore. The second wellbore casing tubular has an end receptacle. A well control tool is suspended in the wellbore. The well control tool includes a lower tool string having a downhole end, an uphole end, and a first conduit for fluid flow extending from the downhole end to the uphole end. The lower tool string has a seal stem at the downhole end. The seal stem has an end face in metal-to-metal contact with a surface of the end receptacle. The well control tool includes an upper tool string having a downhole end, an uphole end, and a second conduit for fluid flow extending from the downhole end to the uphole end. The upper tool string includes a connector releasably coupling the downhole end of the upper tool string to the uphole end of the lower tool string. The well control tool includes a unidirectional valve retrievably pre-installed inside the lower tool string and operable to provide a flow of fluid through the first conduit in a direction from the uphole end of the lower tool string to the downhole end of the lower tool string. The lower tool string may include a packer having at least one packer element forming a seal with the first wellbore casing tubular. The first wellbore casing tubular may contain at least a portion of a leak resulting in a crossflow from the first formation zone to the second formation zone.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
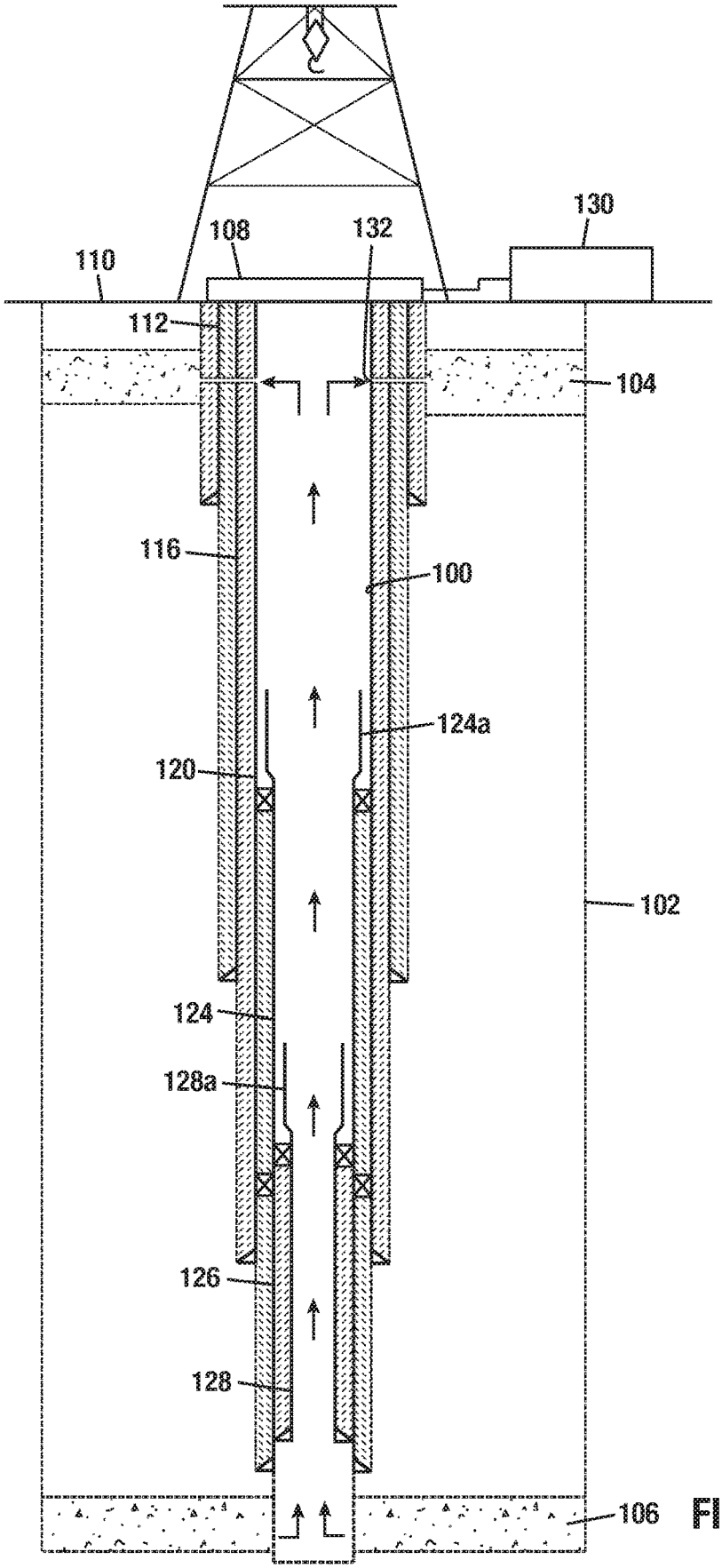
FIG. 1 is a schematic diagram of a wellbore experiencing upward crossflow due to a leak extending across wellbore tubulars installed around the wellbore.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

FIG. 1 illustrates an example wellbore 100 in which a well control tool and method described herein may be applied. Wellbore 100 is formed in a subsurface 102 with multiple formation zones. Formation zones 104, 106 of interest in this example are indicated in FIG. 1. Wellbore 100 may be a water injector, also known as an injection well. Formation zones 104, 106 may be reservoirs of water, for example. Wellbore casing tubulars 112, 116, 120, 124, 126, 128 are installed around wellbore 100. Wellbore casing tubulars 112, 116, 120 may be casings that extend from a wellhead 108 at a surface 110 to a depth within subsurface 102 and surround wellbore 100. Wellbore casing tubulars 124, 126, 128 may be liners that extend between two depths within subsurface 102 and surround wellbore 100. Liners and casings are both made of casing joints. The term "liner" is typically used to describe a casing that does not extend all the way to the surface. Wellbore casing tubulars 124, 128 are illustrated with end receptacles 124*a*, 128*a*, which may be tieback receptacles that enable a new liner to be tied back to an existing liner in a wellbore. Each of end receptacles 124*a*, 128*a* may be, for example, a polished bore receptacle honed with an inner diameter of a sealing surface.

In one illustrative example, wellbore 100 has been drilled to a true depth of 7532 feet, and wellbore casing tubulars 112, 116, 120, 124, 126, 128 have the sizes, starting depths, and end depths shown in Table 1. The wellbore casing tubular depths and sizes shown in Table 1 and the true depth of the wellbore are for illustrative purposes and do not impose any limitations on the well control tool and method described herein. For the illustrative data of Table 1 and FIG. 1, the top of formation zone 104 may be at a depth within 771 feet from surface 110, and the top of formation zone 106 may be at a depth greater than 7253 feet from surface 110. The main relevance of these depths is that formation zone 104 is at a shallower depth compared to formation zone 106.

TABLE 1

| Wellbore Casing Tubular | Size (inches) | Starting Depth (feet) | Ending Depth (feet) |
|---|---|---|---|
| 112 | 18⅝ | 0 | 771 |
| 116 | 13⅜ | 0 | 2366 |
| 120 | 9⅝ | 0 | 5179 |
| 124 | 7 | 1988 | 4874 |
| 126 | 7 | 4874 | 7280 |
| 128 | 4½ | 4674 | 7253 |

Fluid, such as water or brine, may be injected into formation zone 106 by operating a pump 130 at surface 110 to pump fluid through wellhead 108 into wellbore 100. The fluid injected into formation zone 106 may be used to drive production in a production well (not shown). Usually, the deeper formation will be at a higher pressure compared to the shallower formation. (In some cases, due to other factors, the shallower formation may have a higher pressure than the deeper formation.) In injector/disposal wells, the injection pressure can make the formation pressure higher than normal. For illustration purposes, deeper formation zone 106 is at a relatively higher pressure compared to shallower formation zone 104. In this case, when wellbore 100 is shut in, i.e., wellbore 100 is closed off, the pressure gradient between formation zones 104, 106 will drive the injected fluid from deeper formation zone 106 to shallower formation zone 104 if there is a flow path between formation zones 104, 106.

For illustrative purposes, a leak 132 from wellbore 100 is shown. In particular, leak 132 extends across wellbore casing tubulars 112, 116, 120, connecting wellbore 100 to shallower formation zone 104. Each of wellbore casing tubulars 112, 116, 120 contains a portion of leak 132. The type of wellbore casing tubulars where leak 132 is located is not intended to be limiting to the casing type and may be the liner type in some cases. Leaks may be cracks or holes or other mechanical failures that create unintended fluid paths along the wellbore. In the illustrative example, leak 132 is at a very shallow depth relative to surface 110. In general, a leak that is at a depth within 500 ft from the surface may be considered to be a very shallow leak, and a leak that is at a depth of 500 ft to 2000 ft relative to the surface may be considered to be a shallow leak. When wellbore 100 with leak 132 is shut in, fluid will be able to move from deeper formation zone 106 into wellbore 100, up wellbore casing tubulars 128, 124, 120, across leak 132, into shallower formation zone 104. This movement of fluid from a deeper formation zone to a shallower formation zone is described as upward crossflow because the flow is moving in an uphole direction.

One reason for shutting in a wellbore, such as a water injector, may be to run production logs to measure parameters related to the behavior of fluid inside wellbore and flow rates at various depths within the wellbore. From the production logs, it is possible to determine if the wellbore is experiencing crossflow and whether the crossflow is upward or downward. If the wellbore is experiencing upward crossflow, it is typically because there is a leak along the wellbore. In one illustrative example, production logs taken during shut-in conditions of wellbore 100 with leak 132 confirmed the presence of an upward crossflow between formation zones 106, 104 at a flow rate of about 37000 barrels per day. The flow rate stated is for illustrative purposes and is not intended to impose any limitations on the well control tool and method described herein.

Figure 2:
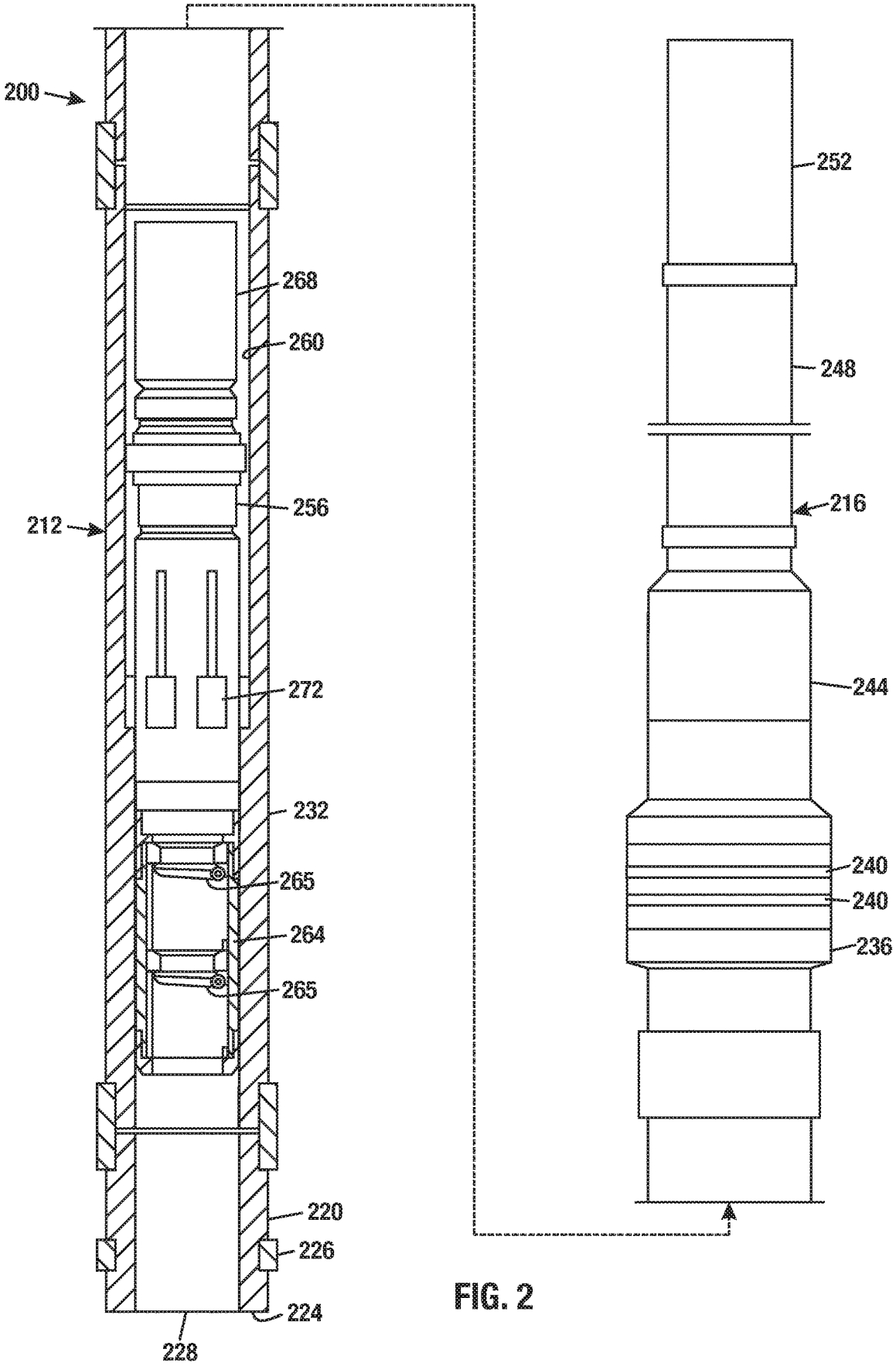
FIG. 2 is a schematic diagram of a well control tool with a pump through plug in a closed position.

FIG. 2 shows an exemplary well control tool 200 that may be used in an operation to secure a wellbore that is experiencing an upward crossflow. Well control tool 200 includes a lower tool string 212 and an upper tool string 216. Lower tool string 212 is the part of well control tool 200 that can be coupled to an end receptacle of an existing wellbore casing tubular, such as a liner, installed around a wellbore. Upper tool string 216 is the part of well control tool 200 that is used to run lower tool string 212 to the end receptacle of the existing wellbore casing tubular and that provides a conduit from a surface location to lower tool string 212. Upper tool string 216 may be used to convey a kill fluid, also known as kill mud, into lower tool string 212. For bullheading of the well, the kill fluid may be appropriately weighted to provide a hydrostatic head with an overbalance in the wellbore and thereby stop the upward crossflow. Upper tool string 216 can be disconnected from lower tool string 212 while lower tool string 212 is in the wellbore and coupled to the existing wellbore casing tubular. Lower tool string 212 may be subsequently removed from the wellbore by a fishing operation.

Lower tool string 212 includes a seal stem 220 at a bottom end or downhole end of well control tool 200. Seal stem 220 is a relatively short tubular body or pipe, e.g., having a length in a range from 6 ft to 15 ft. Seal stem 220 includes an end face 224 to form a metal-to-metal contact with a mating surface of an end receptacle of an existing wellbore casing tubular. This metal-to-metal contact will stop or restrict flow to the leak point (or divert flow into seal stem 220). Seal stem 220 may carry one or more circumferential seals 226 to form additional seals between seal stem 220 and an inner diameter of the end receptacle. Circumferential seals 226 may be elastomer seals. In one example, seal stem 220 may be formed by modifying tieback seal stems known in the art of liner hanger systems. Tieback seal stems in existing liner hanger systems typically have a mule shoe at a downhole end to guide the tieback seal stem into a tieback receptacle of an existing wellbore casing tubular. The mule shoe could be severed from the end of the tieback seal stem, leaving an end surface that can be refurbished to provide a metal-to-metal contact surface.

Lower tool string 212 includes a wellbore casing tubular 232 that is attached to an uphole end of seal stem 220. Wellbore casing tubular 232 may include one or more casing joints and any necessary couplings to connect the casing joints together. A packer 236 is attached to an uphole end of wellbore casing tubular 232. Packer 236 carries one or more packer elements 240 that can be radially expanded to engage a wellbore casing tubular installed around a wellbore, resulting in a seal between the encasing wellbore casing tubular and lower tool string 212. The encasing wellbore casing tubular to be engaged by packer 236 may contain at least a portion of a leak resulting in an upward crossflow in the wellbore. Packer elements 240 may be elastomeric elements. Packer 236 may be a liner top packer known in the art of liner hanger systems. Examples of liner top packers include mechanically-set WTSP4R3 packer from Weatherford and hydraulically-set ZXP liner top packer from Baker Oil Tools. Preferably, the liner top packer used as packer 236 does not have hold-down slips in order to allow packer 236 to be retrievable to the surface after the packer has been set.

Packer 236 may be set, i.e., packer elements 240 may be radially expanded, mechanically or hydraulically using any method known in the art.

Upper tool string 216 includes a releasable connector 244 to releasably couple upper tool string 216 to lower tool string 212. Releasable connector 244 may be, for example, a liner running tool and may be releasable mechanically or hydraulically using any known method in the art. An example of a liner running tool is an R Running Tool with Mechanical Release from Weatherford. Upper tool string 216 includes a heavy weight pipe 248 attached to releasable connector 244. Heavy weight pipe 248 may include one or more drill collars, or other heavy weight pipe joints, and any necessary couplings to connect the drill collars or pipe joints together. Upper tool string 216 includes a pipe 252 that may be used to connect well control tool 200 to a rig support, such as a top drive. Pipe 252 may be, for example, a drill pipe and will typically be lighter in weight compared to heavy weight pipe 248.

Each of seal stem 220, wellbore casing tubular 232, and packer 236 contains a portion of a conduit 260 running from a downhole end of lower tool string 212 to an uphole end of lower tool string 212. When seal stem 220 is engaged with an end receptacle of an existing wellbore casing tubular encasing a wellbore, fluid in the wellbore can enter conduit 260 through an opening at end face 224 of seal stem 220. Each of releasable connector 244, heavy weight pipe 248, and pipe 252 contains a portion of a conduit running from a downhole end of upper tool string 216 (i.e., the end that will be connected to lower tool string 212) to an uphole end of upper tool string 216 (i.e., the end that will at the surface). The conduit in upper tool string 216 is in fluid communication with conduit 260 in lower tool string 212 when the upper tool string 216 is releasably connected to lower tool string 212 by releasable connector 244.

Figure 3:
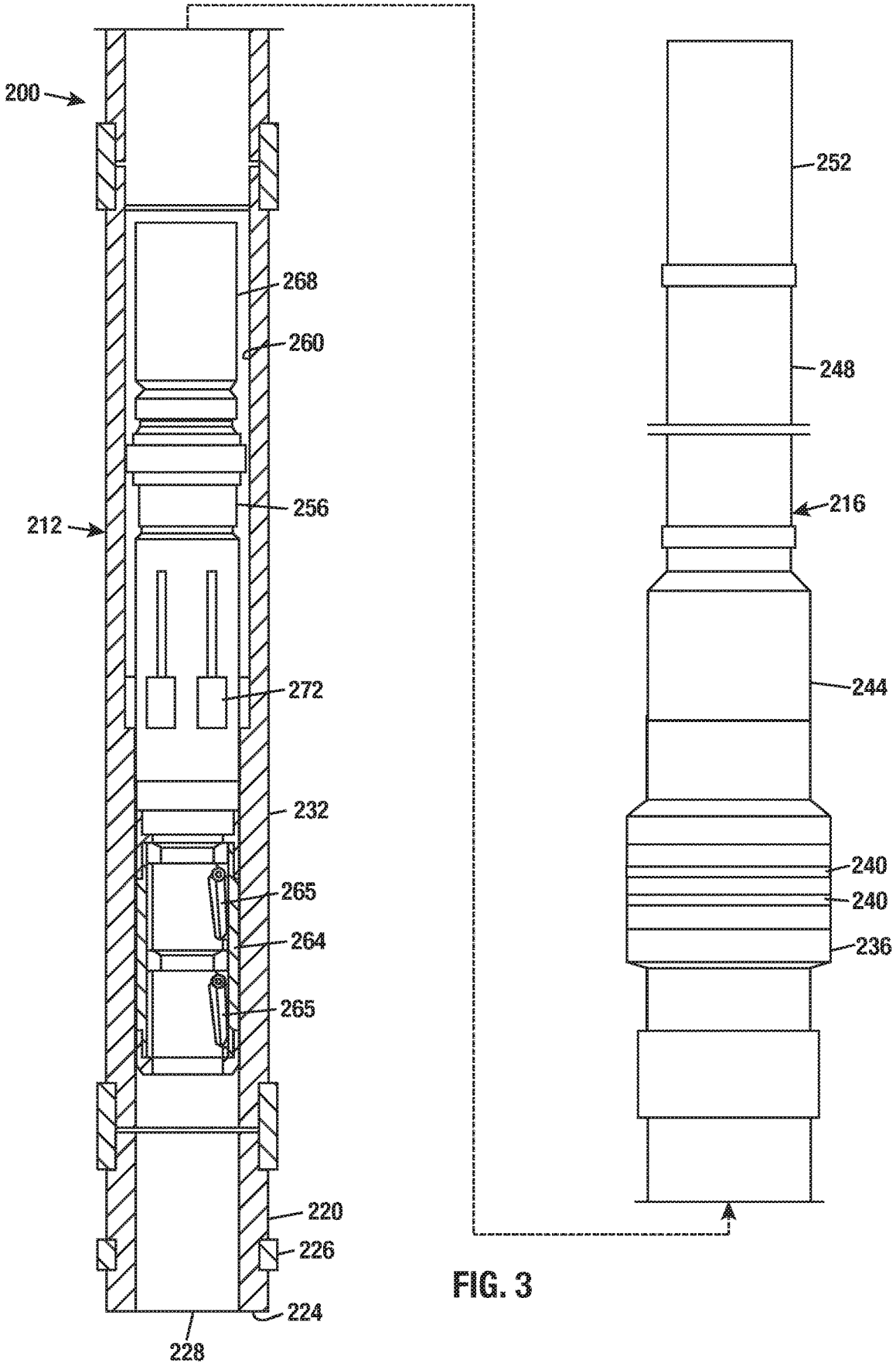
FIG. 3 is a schematic diagram of the well control tool of FIG. 2 with the pump through plug in an open position.

A pump through plug 256 is installed inside conduit 260 of lower tool string 212. Pump through plug 256 occupies an inner diameter of wellbore casing tubular 232 and forms a flow control through the portion of conduit 260 in wellbore casing tubular 232. Pump through plug 256 includes a unidirectional valve 264 that allows flow in a downhole direction towards seal stem 220 while inhibiting flow in an uphole direction towards upper tool string 216. Pump through plug 256 prevents wellbore fluid that may enter conduit 260 from opening 228 of seal stem 220 from flowing into the conduit inside upper tool string 216. At the same time, pump through plug 256 allows kill fluid pumped into upper tool string 216 from the surface to flow into seal stem 220 and out of opening 228 into the wellbore. Valve 264 may be any suitable valve mechanism to provide a unidirectional valve that is normally closed. For illustrative purposes, valve 264 is shown as a dual flapper valve with flapper elements 265. The flapper elements are held in a normally closed position, e.g., by means of springs (not shown). When fluid pressure acting from above the flapper elements exceeds fluid pressure acting from below the flapper elements, the flapper elements will swing open to provide a passage for fluid to flow through. FIG. 3 shows flapper elements 265 in the open position. Flapper elements 265 will swing back to the closed when the pressure acting from above the valve is below the pressure acting from below the valve. Other valve elements besides flapper elements may be employed in valve 264. Pump through plug 256 may include a fishing neck 268 that allows retrieval of pump through plug 256 from the installed position inside lower tool string by a fishing operation. Pump through plug 256 may be installed inside conduit 260 by engaging locks 272 on pump through plug 256 with an inner diameter of wellbore casing tubular 232. One commercial example of a pump through plug that may be used as pump through plug 256 is available as ME plug from Interwell Company.

Figure 4:
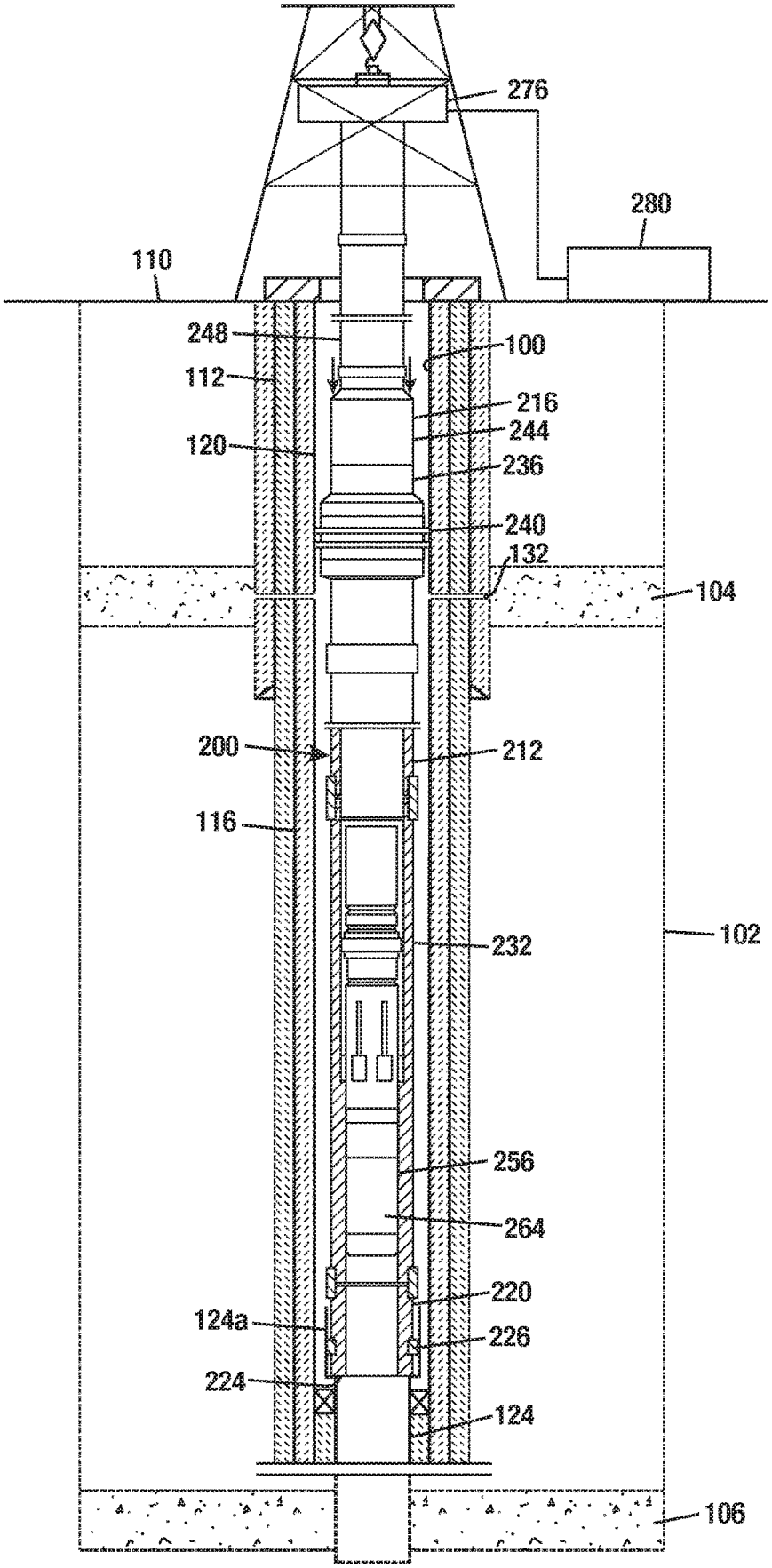
FIG. 4 is a schematic diagram showing the well control tool of FIGS. 2 and 3 disposed in the well of FIG. 1.

FIG. 4 shows well control tool 200 in a position to secure wellbore 100 that is experiencing upward crossflow due to leak 132. Upper tool string 216 of well control tool 200 is connected to a top drive 276 at a position above surface 110. A pump 280 is connected to pump fluid, such as kill fluid, into upper tool string 216 through top drive 276. Lower tool string 212 extends to existing wellbore casing tubular 124 encasing a portion of wellbore 100. Wellbore casing tubular 124 is selected as a target because wellbore casing tubular 124 has a end receptacle **124*a* to engage seal stem 220 of lower tool string 212 and is located downhole of leak 132. As shown, seal stem 220 of lower tool string 212 is received in end receptacle 124*a*. A metal-to-metal contact between end face 224 of seal stem 220 and the mating surface of end receptacle 124*a*, together with the weight of well control tool 200, will stop or restrict the flow to the leak point (i.e., stop or restrict passage of fluid between seal stem 220 and end receptacle 124*a*). Additional seals may be formed between seal stem 220 and end receptacle 124*a* by circumferential seal(s) 226 carried by seal stem 220**.

In the use position of well control tool 200 shown in FIG. 4, well control tool 200 has a length that extends from top drive 276 to end receptacle **124*a*. This length can be several hundreds to thousands feet long. Using the data shown in Table 1, for example, this length is greater than 1988 feet. This typically means that it is not possible to fully assemble well control tool 200 at the surface prior to running well control tool 200 into the wellbore. Instead, well control tool 200 will be assembled incrementally and lowered into the wellbore incrementally. In one implementation, the location of valve 264 in lower tool string 212 is selected such that by the time seal stem 220 enters the area of wellbore 100 adjacent to leak 132, valve 264 will be in the portion of lower tool string 212 extending into wellbore 100. Let L1 be the distance between valve 264 and end face 224 of seal stem 220, and let L2 be the distance between surface 110 and the depth of leak 132. In this case, L1 may be selected to be less than L2 to ensure that valve 264 will be in the portion of lower tool string 212 extending into the wellbore 100 by the time end face 224 of seal stem 220 is at the leak area. In general, the closer valve element 264 is to seal stem 220, the shallower the leak that can be handled by well control tool 200. The shortest distance L1 occurs when valve element 264 is installed in a portion of wellbore casing tubular 232 that is immediately adjacent to seal stem 220. In one example, well control tool 200 is designed to secure wells with shallow leaks. In one example, L1 is selected to be less than 500 feet to allow well control tool 200 to handle a leak at a depth of 500 feet or greater. In another example, L1 is less than 375 feet to allow well control tool 200 to handle a leak at a depth of 375 feet or greater. In yet another example, L1 is less than 100 feet to allow well control tool 200** to handle a leak at a depth of 100 feet or greater.

Another design variable to be taken into consideration is the location of packer 236 on lower tool string 212. In one implementation, the length of lower tool string 212 is such that lower tool string 212 extends into leaking wellbore casing tubular 120 and an annulus is formed between lower tool string 212 and leaking wellbore casing tubular 120. In this case, packer 236 is positioned within leaking wellbore casing tubular 120, and packer elements 240 engage leaking wellbore casing tubular 120 to form an upper seal in the annulus. A lower seal in the annulus is provided by engagement of seal stem 220 with end receptacle 124*a*. In one implementation, the location of packer 236 on lower tool string 212 and the length of lower tool string 212 are such that packer elements 240 engage leaking wellbore casing tubular 120 at a location uphole of leak 132 to form the upper seal. In this case, leak 132 is between the upper and lower seals formed in the annulus. With this arrangement, wellbore casing tubular 232 of lower tool string 212 will serve as a liner for the portion of wellbore casing tubular 120 containing leak 132, and the upper and lower seals formed in the annulus between wellbore casing tubulars 120, 232 will isolate leak 132 behind well casing tubular 232.

Another design variable to be taken into consideration are the forces exerted in the wellbore. Well control tool 200 should have sufficient downward force to overcome the upward force generated by the upward crossflow. The upward force, $F_{up}$, exerted on valve 264 by the upward flow coming from below seal stem 220 may be determined as reservoir pressure less the hydrostatic head below valve 264. The downward force, $F_{down}$, exerted on valve 264 has multiple components. Kill fluid is pumped into the well control tool while running the well control tool to the existing wellbore casing tubular in the well. A first component, $F_1$, of the downward force is determined by the hydrostatic head of the kill fluid on valve 264 while lowering the well control tool inside the wellbore. A second component, $F_2$, of the downward force is determined by the hydrostatic head of the wellbore fluid acting on the outside of releasable connector 244, as shown by the downward arrows on releasable connector 244. A third component, $F_3$, of the downward force is determined by the weight of wellbore casing tubular 232 in lower tool string 212 in the wellbore fluid. A fourth component, $F_4$, of the downward force is determined by the weight of heavy weight pipe 248 in the wellbore fluid. $F_{down}$ may be taken as the sum of $F_1$, $F_2$, $F_3$, and $F_4$. The weights of wellbore casing tubular 232 and heavy weight pipe 248 in the wellbore fluid and the weight of the kill fluid pumped into well control tool 200 can be selected such that $F_{down}$ will exceed $F_{up}$ as well control tool 200 is being lowered to the existing wellbore casing tubular in the wellbore.

Figure 5:
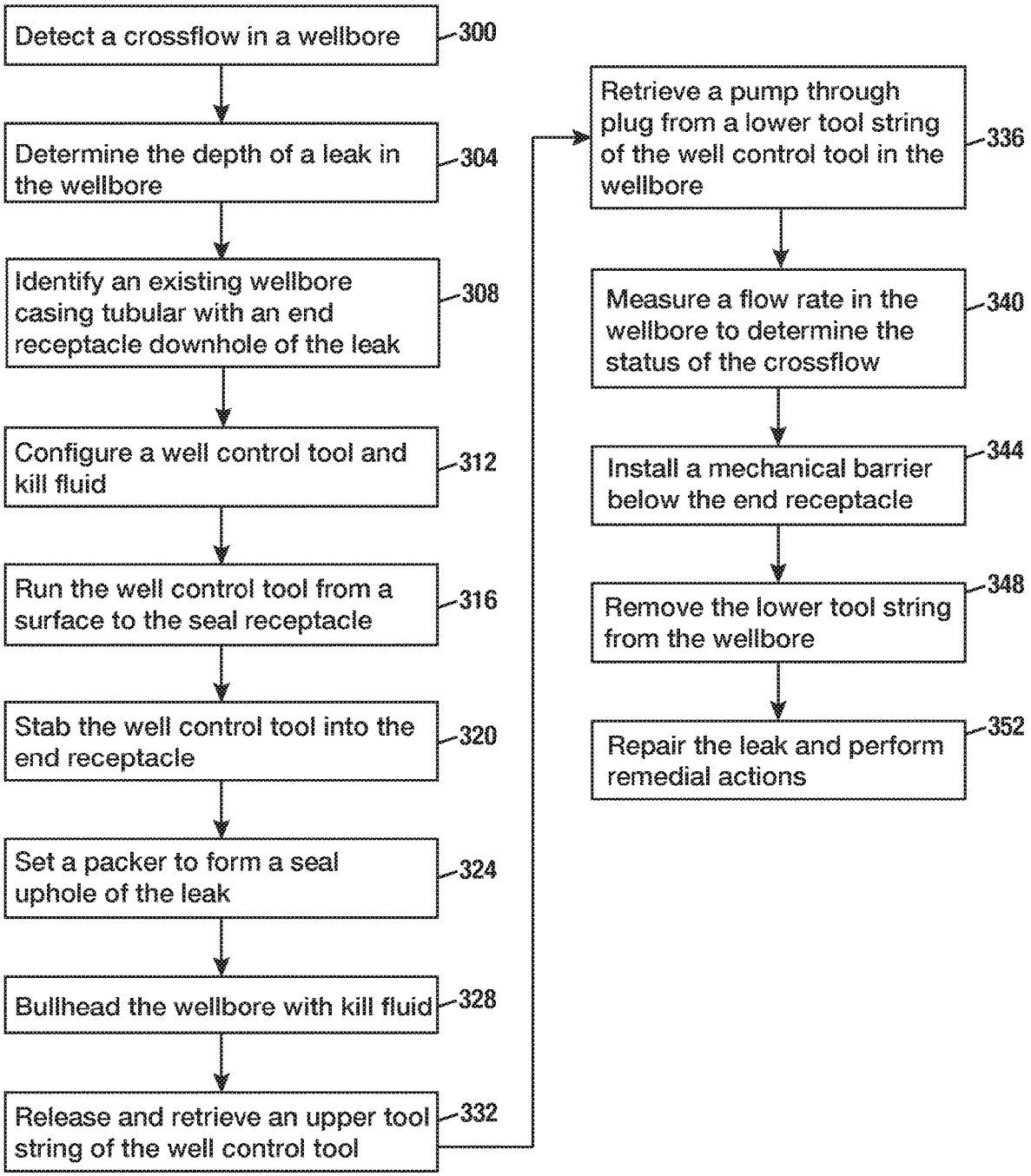
FIG. 5 is a flowchart illustrating a method of securing the wellbore of FIG. 1 using the well control tool of FIGS. 2 and 3.

FIG. 5 is a flowchart illustrating an exemplary method of securing a well using well control tool 200. At 300, a crossflow from a higher pressured formation zone (106 in FIG. 1) to a lower pressured formation zone (104 in FIG. 1) through a wellbore (100 in FIG. 1) is detected. The wellbore traverses both formation zones and is encased with a plurality of wellbore casing tubulars. The crossflow may be an upward crossflow in that the higher pressured formation zone is located at a greater depth compared to the lower pressured formation zone so that the crossflow moves in an upward, or uphole, direction in the wellbore. The crossflow may be detected from a production log run in the wellbore while the wellbore is in a shut-in condition or from other measurements related to the behavior of fluid in the wellbore. At 304, a wellbore casing tubular (120 in FIG. 1) containing at least part of a leak involved in the crossflow is identified, and the depth of the leak (132 in FIG. 1) is determined. The depth of the leak can be determined from the production logs or other flow data expressing the crossflow. The wellbore casing tubular containing at least part of the leak can be identified from information about construction of the wellbore. At 308, using information about construction of the wellbore, an existing wellbore casing tubular (124 in FIG. 1) installed around the wellbore and having an end receptacle (124*a* in FIG. 1) that is positioned downhole of the leak is identified.

At 312, the well control tool (200 in FIGS. 2-4) is configured. The upward force generated by the crossflow is calculated. The downward force that would be needed to ensure that the well control tool will be able to overcome the upward force is calculated based on a planned configuration of the well control tool and a kill fluid to be pumped into the well control tool while running the well control tool into the wellbore. The planned configuration of the well control tool and weight of the kill fluid are adjusted as needed to achieve an overall downward force that will overcome the upward force from the crossflow. At 316, the well control tool is incrementally assembled according to the planned configuration and run into the wellbore until the seal stem (220 in FIGS. 2-4) at the downhole end of the well control tool is at the end receptacle of the existing wellbore casing tubular. At 320, the seal stem of the well control tool is inserted into the end receptacle, and a metal-to-metal contact is formed between the seal stem and the end receptacle.

While the well control tool is incrementally assembled and run into the wellbore at 316, the downhole end of the lower tool string, i.e., the opening at the end of the seal stem, is exposed to fluid (e.g., crossflow) in the wellbore. The pump through plug (256 in FIGS. 2-4) preinstalled in the lower tool string will prevent the fluid that enters the lower tool string through the seal stem from moving into the upper tool string. As previously described, the location of the unidirectional valve (264 in FIGS. 2-4) of the pump through plug is such that by the time the downhole end of the lower tool string reaches the depth of the leak, the valve is already in the portion of the lower tool string extending into the wellbore. Also, while the well control tool is incrementally assembled and run into the wellbore, kill fluid is pumped into the portion of the well control tool extending into the well according to the calculations at 312. At this point, the weight of the kill fluid may not be configured for bullheading of the wellbore.

At 324, a packer (256 in FIGS. 2-4) carried by the lower tool string is set to form a seal between the well control tool and the wellbore casing tubular containing the leak. In one example, the packer may be set by applying a weight on top of the packer that radially expands packer elements of the packer. With the well control tool extending from the surface to the existing wellbore casing tubular with the end receptacle, and the length of the lower tool string selected such that the packer seals uphole of the leak, the leak will be covered by the lower tool string and will cease to pay a role in the crossflow. At 328, the well is bullheaded. Bullheading involves pumping a kill fluid into the wellbore through the well control tool. The weight of the kill fluid is selected to provide a hydrostatic head with overbalance. The overbalance may be, for example, 200 psia, which is a typical overbalance cut-off used by operators to kill water injectors. Overbalance is the positive difference between hydrostatic pressure in the well and the formation pressure. In this case, the target formation is the higher pressured formation zone 106 where the crossflow originated. To determine the weight of the kill fluid, the height of the hydrostatic column may be considered to be from the surface (110 in FIG. 4) or wellhead to the deeper higher pressured formation zone since the leak is isolated behind the lower tool string of the well control tool. The kill fluid pumped into the wellbore will push fluid back into the higher pressured formation zone, and the overbalance will prevent further fluid influx into the wellbore from the higher pressured formation zone.

Various types of kill fluid may be configured to achieve a kill fluid with the desired weight. Table 2 shows one non-limiting example configuration of a kill fluid for bullheading. The example shown in Table 2 provides fluid weight of 92 pounds per cubic feet. (In Table 2, "ALAP" means "as low as possible".)

TABLE 2

| Material | Quantity | Target Fluid Properties | Value |
|---|---|---|---|
| Water | 0.675 barrels | Density | 92 lb/ft$^3$ |
| Xanthan Gum | 0.25-1.0 lb | Plastic Viscosity (PV) | ALAP cp |
| Starch | 4-6 lb | Yield Stress (YP) | 20-25 lb/100 ft$^2$ |
| $CaCl_2$ (77% Purity) | 141 lb | 6 RPM | 8-12 |
| $CaCO_3$ | 133 lb | Gels 10 sec/10 min | 8-12/12-16 lb/100 ft$^2$ |

Figure 6:
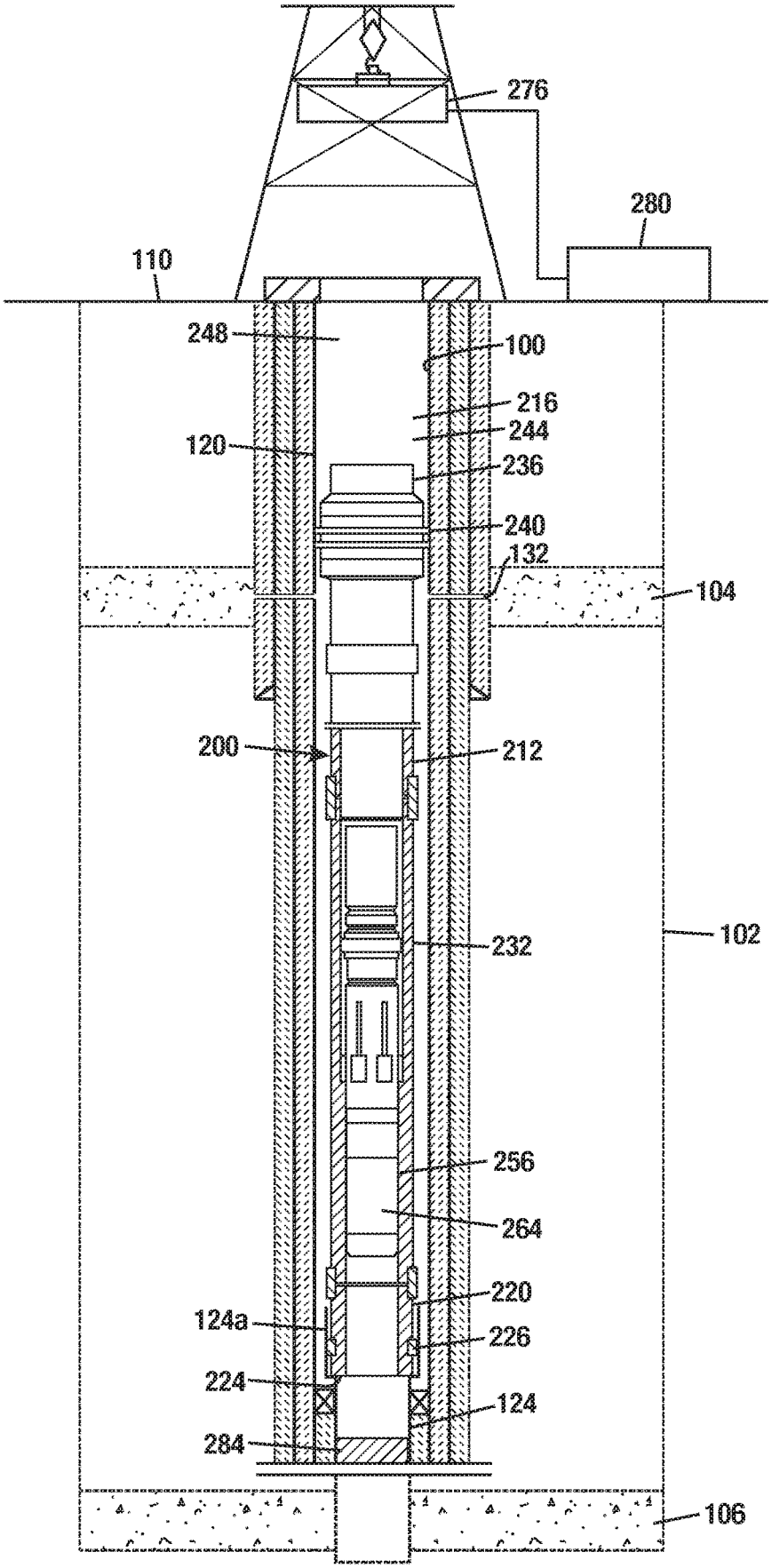
FIG. 6 is a schematic diagram showing a lower tool string of the well control tool in the wellbore and a mechanical barrier installed below the lower tool string.
Figure 7:
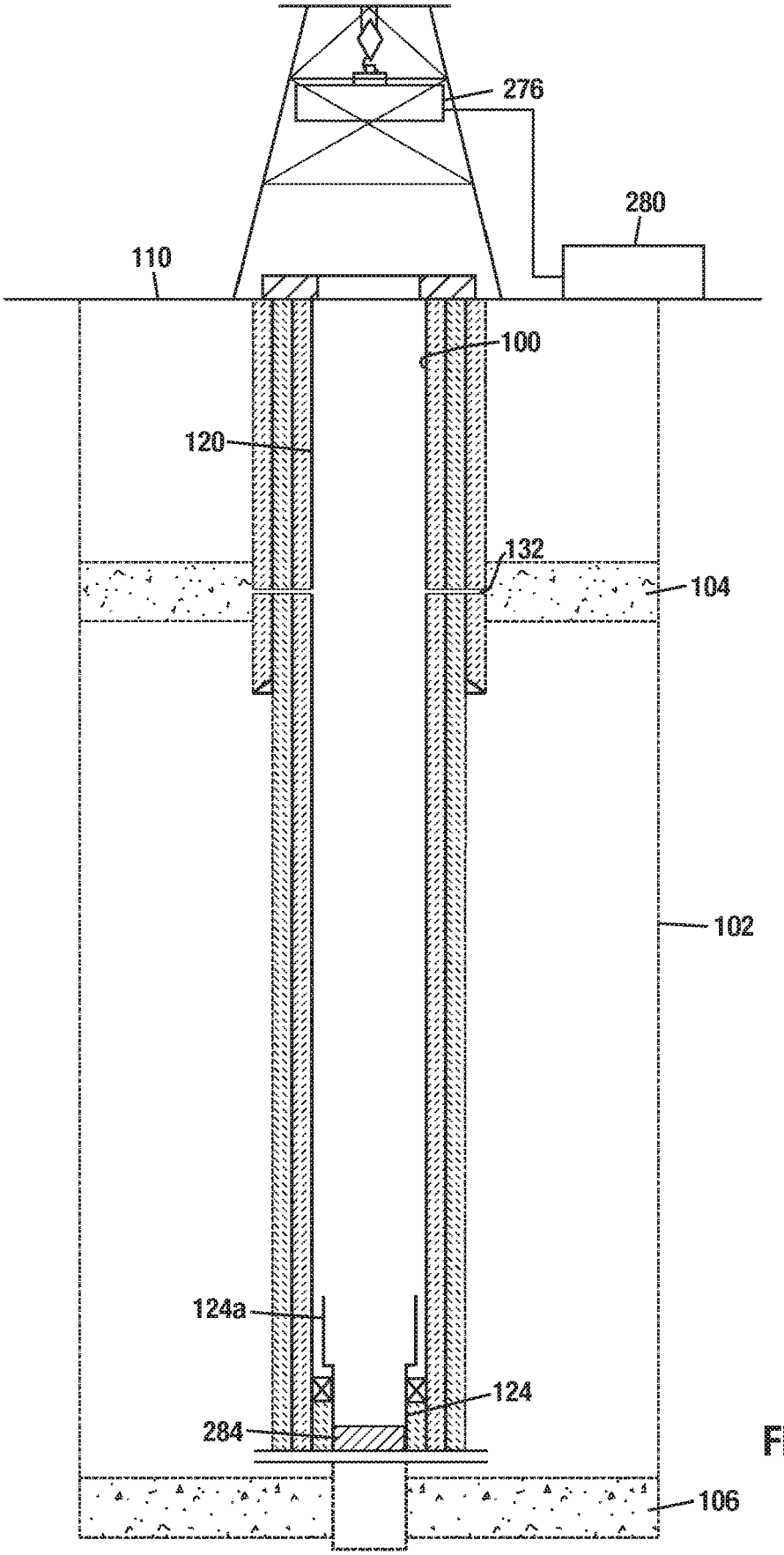
FIG. 7 is a schematic diagram showing a wellbore with a mechanical barrier installed to isolate a higher pressure formation zone and a leak area in the wellbore exposed for repair.

At 332, the releasable connector (244 in FIGS. 2-4) is released, detaching the upper tool string from the lower tool string. The upper tool string is pulled out of the wellbore, leaving the lower tool string and packer inside the wellbore, as shown in FIG. 6. Returning to FIG. 5, at 336, the pump through plug is retrieved from the lower tool string. At 340, a flowmeter is run into the wellbore through the lower tool string to ensure that the wellbore is dead after the bullheading of 328 and that upward crossflow in the wellbore has been eliminated. At 344, after confirming that the crossflow has ceased, a mechanical barrier is installed in the wellbore to ensure proper isolation of the deeper higher pressured formation. The mechanical barrier may be a downhole plug that can be lowered through the lower tool string to a depth downhole of the end receptacle and then expanded to engage the wall of an existing wellbore casing tubular in the wellbore. An example of an installed mechanical barrier 284 is shown in FIG. 6. Isolation of the deeper higher pressure formation will allow for remedial actions to be completed at the leak depth safely. Returning to FIG. 5, at 348, a fishing assembly is run into the wellbore to retrieve the lower tool string. After the lower tool string is removed from the wellbore, the leak area will be exposed at a portion of the wellbore above the mechanical barrier, as shown in FIG. 7. Returning to FIG. 5, at 352, the leak is repaired and any additional remedial actions required are performed. The leak may be repaired, for example, by cementing a scab liner to the leak interval.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. A method comprising:

in response to detecting a crossflow in a wellbore, determining a depth of a leak that is formed at least partially in a first wellbore casing tubular installed around the wellbore and disposed in a path of the crossflow;

identifying a second wellbore casing tubular installed around the wellbore and having an end receptacle that is positioned downhole of the depth of the leak;

from a surface, incrementally assembling and lowering a well control tool comprising a lower tool string releasably coupled to an upper tool string into the wellbore until a downhole end of the lower tool string is positioned in mating contact with the end receptacle;

while incrementally assembling and lowering the well control tool, exposing a conduit of the lower tool string to the crossflow and inhibiting movement of the crossflow from the lower tool string into the upper tool string by a unidirectional valve preinstalled inside the lower tool string;

supplying a kill fluid from the surface into the wellbore through the well control tool and unidirectional valve with a weight of the kill fluid selected to provide a hydrostatic head in the wellbore with an overbalance; and retrieving the unidirectional valve from the lower tool string to the surface, wherein the first wellbore casing tubular is coupled to a seal stem and the lower tool string comprises a packer coupled to the first wellbore casing tubular, the packer comprising at least one radially expandable packer element, the seal stem having an end face to make a metal-to-metal contact, wherein the unidirectional valve is located in a portion of a conduit within the first wellbore casing tubular, and wherein a location of the unidirectional valve relative to the end face of the seal stem is based on the depth of the leak in the well.

2. The method of claim 1, further comprising detecting the crossflow that is moving from a first formation zone to a second formation zone, wherein the first formation zone is at a higher pressure and a greater depth compared to the second formation zone.

3. The method of claim 2, further comprising releasing the upper tool string from the lower tool string and retrieving the upper tool string to the surface prior to retrieving the unidirectional valve from the lower tool string.

4. The method of claim 3, further comprising installing a mechanical barrier at a depth in the wellbore downhole of the end receptacle to isolate the first formation zone from a portion of the wellbore containing the leak.

5. The method of claim 4, further comprising detecting an absence of the crossflow in the wellbore prior to installing the mechanical barrier.

6. The method of claim 5, wherein detecting the absence of the crossflow comprises measuring a rate of fluid flow in the wellbore.

7. The method of claim 4, further comprising retrieving the lower tool string from the wellbore to the surface after installing the mechanical barrier.

8. The method of claim 7, further comprising repairing the leak.

9. The method of claim 2, wherein incrementally assembling and lowering the well control tool comprises lowering the well control tool until the metal-to-metal contact is formed between the seal stem at the downhole end of the lower tool string and the end receptacle.

10. The method of claim 9, further comprising forming a seal in an annulus between the lower tool string and the first wellbore casing tubular at a depth uphole of the depth of the leak.

11. The method of claim 2, further comprising supplying the kill fluid from the surface into the well control tool while incrementally lowering the well control tool into the wellbore with the weight of the kill fluid selected to overcome at least a portion of an upward force generated by the crossflow.

12. An apparatus comprising:

a lower tool string having a downhole end, an uphole end, and a first conduit for fluid flow extending from the downhole end to the uphole end, the lower tool string comprising a seal stem at the downhole end, the seal stem having an end face to make a metal-to-metal contact;

an upper tool string having a downhole end, an uphole end, and a second conduit for fluid flow extending from the downhole end to the uphole end, the upper tool string comprising a connector releasably coupling the downhole end of the upper tool string to the uphole end of the lower tool string; and a unidirectional valve retrievably installed inside the first conduit and operable to provide a flow of fluid in the first conduit in a direction from the uphole end of the lower tool string to the downhole end of the lower tool string, wherein the lower tool string comprises a wellbore casing tubular coupled to the seal stem and a packer coupled to the wellbore casing tubular, the packer comprising at least one radially expandable packer element, wherein the unidirectional valve is located in a portion of the first conduit within the wellbore casing tubular, and wherein a location of the unidirectional valve relative to the end face of the seal stem is based on a depth of a leak in a well.

13. The apparatus of claim 12, wherein the unidirectional valve is disposed in a portion of the wellbore casing tubular immediately adjacent to the seal stem.

14. The apparatus of claim 12, wherein a distance of the unidirectional valve along the lower tool string relative to the end face of the seal stem is less than 500 feet or 152 meters.

15. A system comprising:

a wellbore traversing a first formation zone and a second formation zone, wherein the first formation zone is at a higher pressure and a greater depth compared to the second formation zone;

a first wellbore casing tubular installed around the wellbore;

a second wellbore casing tubular installed around the wellbore, the second wellbore casing tubular having an end receptacle; and a well control tool suspended in the wellbore, the well control tool comprising:

a lower tool string having a downhole end, an uphole end, and a first conduit for fluid flow extending from the downhole end to the uphole end, the lower tool string comprising a seal stem at the downhole end, the seal stem having an end face in metal-to-metal contact with a surface of the end receptacle;

an upper tool string having a downhole end, an uphole end, and a second conduit for fluid flow extending from the downhole end to the uphole end, the upper tool string comprising a connector releasably coupling the downhole end of the upper tool string to the uphole end of the lower tool string; and a unidirectional valve retrievably preinstalled inside the lower tool string and operable to provide a flow of fluid through the first conduit in a direction from the uphole end of the lower tool string to the downhole end of the lower tool string, wherein the first wellbore casing tubular is coupled to the seal stem and the lower tool string further comprises a packer coupled to the first wellbore casing tubular, the packer comprising at least one radially expandable packer element, wherein the unidirectional valve is located in a portion of the first conduit, and wherein a location of the unidirectional valve relative to the end face of the seal stem is based on a depth of a leak in a well.

16. The system of claim 15, wherein the first wellbore casing tubular contains at least a portion of a leak resulting in a crossflow from the first formation zone to the second formation zone.

* * * * *